US009399547B2

(12) United States Patent
Bartoli et al.

(10) Patent No.: US 9,399,547 B2
(45) Date of Patent: Jul. 26, 2016

(54) CAPSULE FOR BEVERAGES

(71) Applicant: SARONG SOCIETA' PER AZIONI, Reggiolo (Reggio Emilia) (IT)

(72) Inventors: Andrea Bartoli, Reggio Emilia (IT); Davide Capitini, Reggio Emilia (IT); Alessandro Grillenzoni, Modena (IT)

(73) Assignee: SARONG SOCIETA' PER AZIONI, Reggiolo (IT)

( * ) Notice: Subject to any disclaimer, the term of this patent is extended or adjusted under 35 U.S.C. 154(b) by 0 days.

(21) Appl. No.: 14/655,157

(22) PCT Filed: Dec. 23, 2013

(86) PCT No.: PCT/IB2013/061267
§ 371 (c)(1),
(2) Date: Jun. 24, 2015

(87) PCT Pub. No.: WO2014/102702
PCT Pub. Date: Jul. 3, 2014

(65) Prior Publication Data

US 2015/0329282 A1 Nov. 19, 2015

(30) Foreign Application Priority Data

Dec. 27, 2012 (IT) ..... MO12A0327
Oct. 17, 2013 (IT) ..... MO13A0296
Nov. 20, 2013 (IT) ..... MO13A0320

(51) Int. Cl.
*B65D 85/804* (2006.01)
*B01F 15/00* (2006.01)
(Continued)

(52) U.S. Cl.
CPC ..... *B65D 85/8046* (2013.01); *B01F 1/0011* (2013.01); *B01F 7/00291* (2013.01);
(Continued)

(58) Field of Classification Search
CPC ..... B65D 85/8043; B01F 7/00916
See application file for complete search history.

(56) References Cited

U.S. PATENT DOCUMENTS

2007/0196402 A1 8/2007 De La Mettrie et al.
2011/0045144 A1 2/2011 Boussemart et al.
(Continued)

FOREIGN PATENT DOCUMENTS

DE 102010030988 A1 1/2012
EP 2412645 A1 2/2012
(Continued)

OTHER PUBLICATIONS

International Preliminary Report on Patentability Application No. PCT/IB2013/061267 Mailing Date: Apr. 15, 2015, 14 pages.
(Continued)

*Primary Examiner* — Erik Kashnikow
*Assistant Examiner* — Chaim Smith
(74) *Attorney, Agent, or Firm* — Whitmyer IP Group LLC

(57) ABSTRACT

A capsule, including: a casing containing an initial product to be joined to a fluid for making a final product; a nozzle associated with the casing and having a longitudinal side wall and a first end provided with a first opening suitable to engage a fluid injecting arrangement of a brewing machine, said longitudinal side wall being provided with at least one outflow opening connected to the first opening through a first duct for dispensing said fluid in the cavity in a injecting step; and a mixing element rotatably coupled with the nozzle at the outflow opening and shaped in such a manner as to divert at least one jet of fluid coming from the outflow opening and be rotated by said jet around said nozzle so as to create inside said cavity a vortex flow of fluid and product.

37 Claims, 8 Drawing Sheets

(51) Int. Cl.

| | |
|---|---|
| ***B01F 1/00*** | (2006.01) |
| ***B01F 15/02*** | (2006.01) |
| ***B01F 7/00*** | (2006.01) |

(52) U.S. Cl.

CPC ..... *B01F 7/00916* (2013.01); *B01F 15/00831* (2013.01); *B01F 15/0254* (2013.01); *B65D 85/8043* (2013.01); *B01F 2215/0022* (2013.01)

(56) References Cited

U.S. PATENT DOCUMENTS

| | | | |
|---|---|---|---|
| 2011/0110180 | A1 | 5/2011 | Snider et al. |
| 2011/0244108 | A1 | 10/2011 | Rabin |
| 2012/0070551 | A1 | 3/2012 | Mahlich |

FOREIGN PATENT DOCUMENTS

| | | | |
|---|---|---|---|
| WO | 2007114685 | A1 | 10/2007 |
| WO | 2010137960 | A1 | 12/2010 |
| WO | 2011138405 | A1 | 11/2011 |
| WO | 2012104760 | A1 | 8/2012 |
| WO | 2013105036 | A1 | 7/2013 |
| WO | 2013132450 | A1 | 9/2013 |
| WO | 2013156932 | A1 | 10/2013 |

OTHER PUBLICATIONS

International Search Report and Written Opinion of the International Searching Authority Application No. PCT/IB2013/061267 Completed: May 9, 2014; Mailing Date: May 15, 2014, 9 pages.

Italian Search Report Application No. IT MO20130296 Completed: Jul. 1, 2014 7 pages.

Italian Search Report Application No. IT MO20120327 Completed: Aug. 14, 2013 8 pages.

Italian Search Report Application No. IT MO20130320 Completed: Aug. 7, 2014 7 pages.

Fig. 9
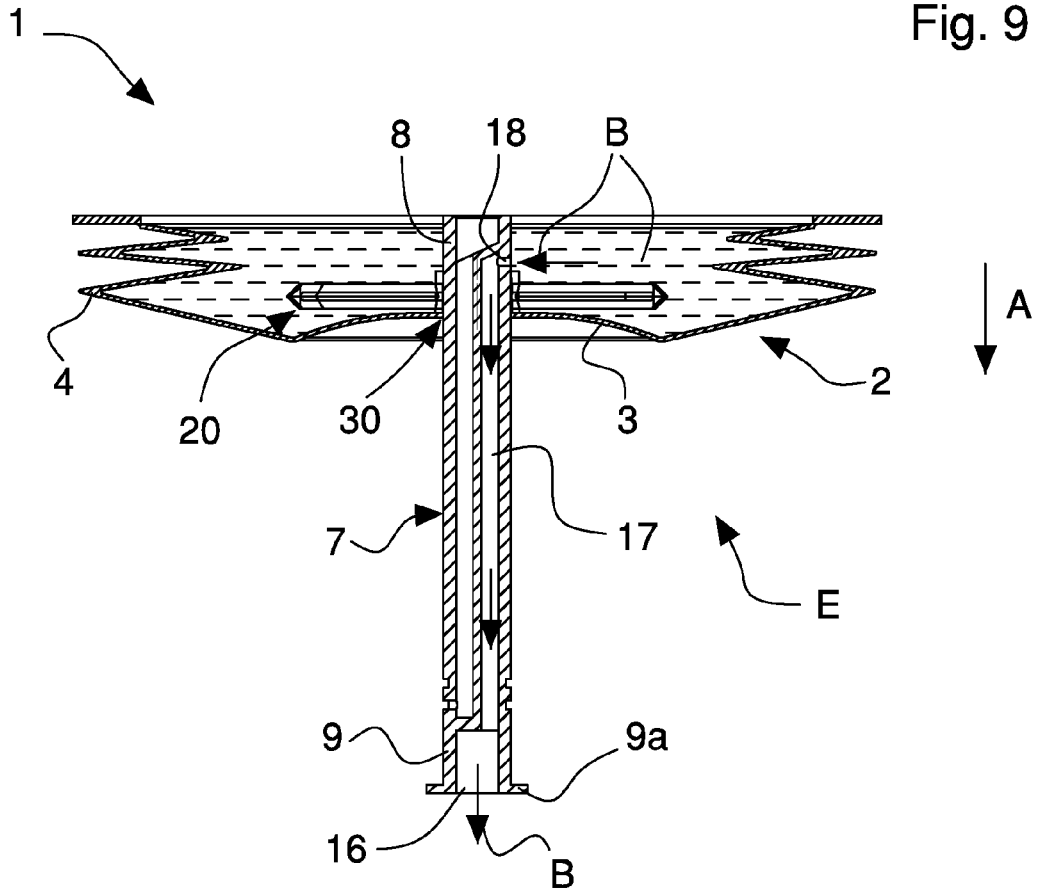
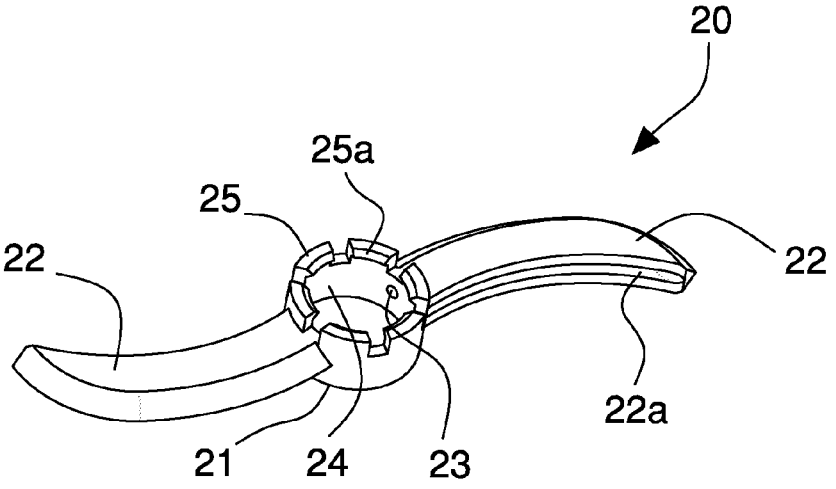
Fig. 8

Fig. 18
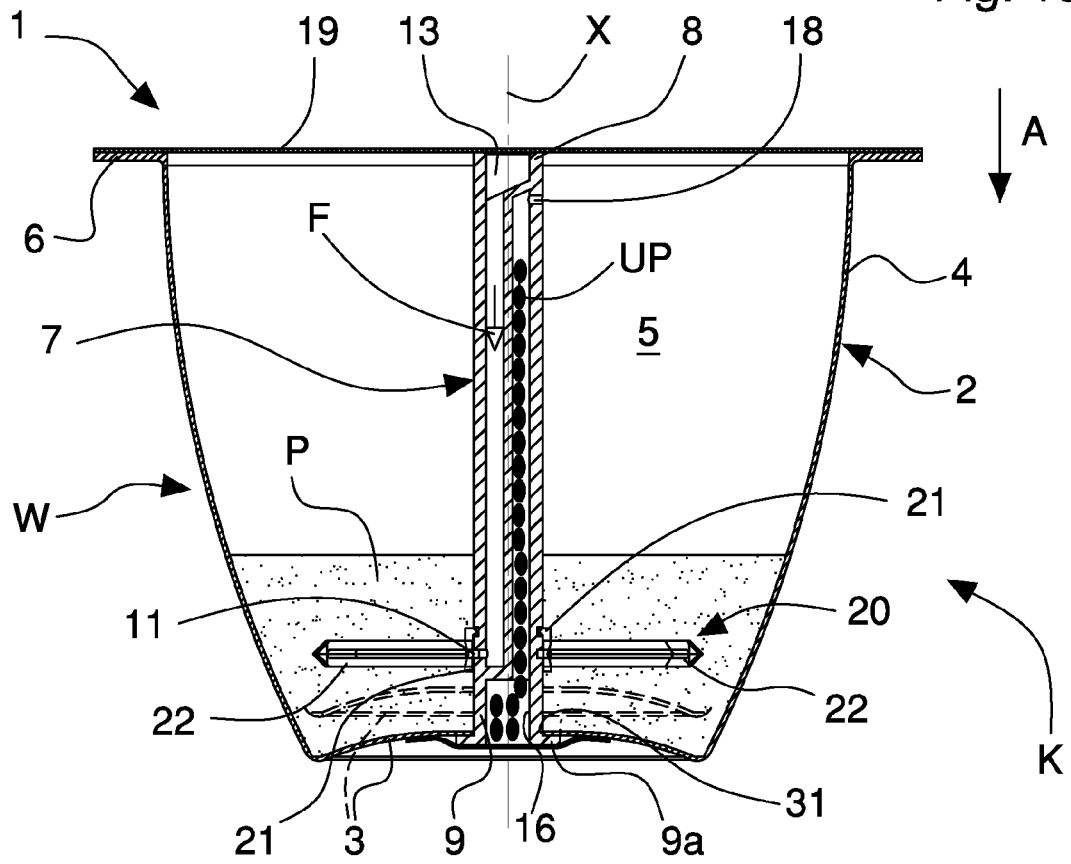
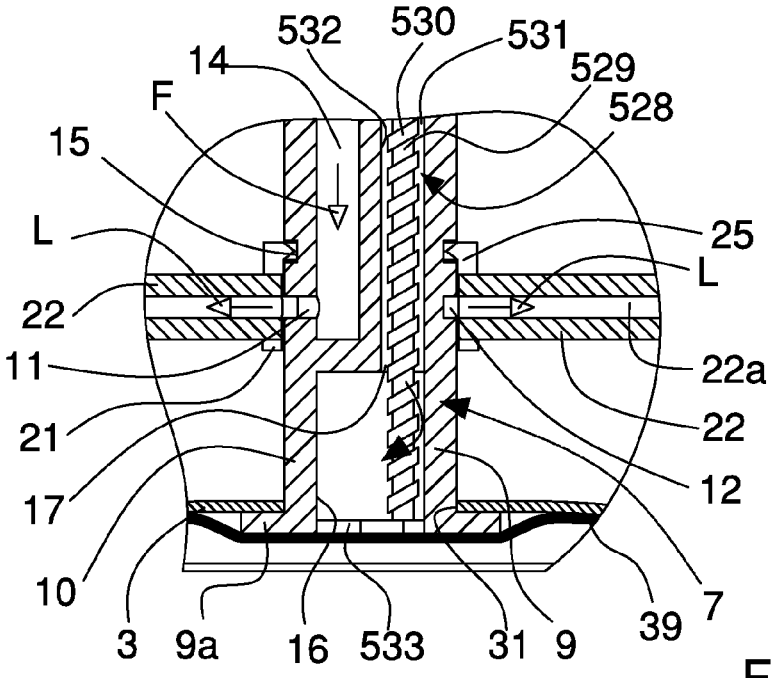
Fig. 19

CAPSULE FOR BEVERAGES

CROSS-REFERENCE TO RELATED APPLICATIONS

This application is a continuation of PCT International Application No. PCT/IB2013/061267 filed Dec. 23, 2013. PCT/IB2013/061267 claims priority to IT Application Nos. MO2012A000327 filed Dec. 27, 2012, MO2013A000296 filed Oct. 17, 2013 and MO213A000320 filed Nov. 20, 2013. The entire contents of these applications are incorporated herein by reference.

FIELD OF THE INVENTION

The invention relates to capsules or containers for preparing beverages in automatic brewing machines, and in particular it relates to a sealed single-dose and disposable capsule containing a soluble, or freeze-dried, or dehydrated initial product capable of making a final product, for example, a beverage, by interacting with a pressurized fluid, typically water or milk.

BACKGROUND OF THE INVENTION

The known capsules for use in known brewing machines are disposable and single-dose containers comprising an external casing, made of liquid- and gas-impermeable plastics and having the shape of a glass or a cup. In particular, the casing has a bottom wall and a side wall defining a cavity provided with an upper opening through which the product can be inserted from which the beverage can be obtained. The upper opening is hermetically sealed by a cover, typically an aluminium or plastic film sheet, so as to seal the product inside the container cavity. The capsule is perforable to allow the inflow of pressurized liquid, typically water, and the exit of the obtained beverage. In particular, the cover and the bottom wall of the casing are perforable by a suitable arrangement of the brewing machine, to allow the dispensing from the top of the pressurized liquid and the extraction from the bottom of the beverage, respectively.

A drawback of the known capsules disclosed above is that they can be used only in brewing machines provided with a special dispensing circuit comprising an extracting arrangement suitable to perforate the capsule bottom to allow the outflow of the beverage, and a duct arrangement suitable to convey the beverage to the fruition container (for example, a mug, a cup, a glass, etc.). Such a dispensing circuit makes the machine structure more complex and expensive. Furthermore, since such dispensing circuit is in contact with the dispensed beverages, it should be suitably washed after each dispensing operation, both for hygienic reasons, and not to compromise the taste and quality (organoleptic qualities) of a beverage that is subsequently dispensed (for example, an aromatic infusion dispensed after a coffee). However, a washing arrangement of the dispensing circuit is not always present in the known machines, due to their manufacturing complexity and costs.

The known brewing machines further comprise a supply circuit provided with an injection arrangement (typically, needles or sharpened nozzles) providing to perforate the cover and dispense the pressurized liquid coming from a pump and/or a boiler.

During the production operative step of the beverage, the injection arrangement can contact the product and/or the beverage, thus getting contaminated. As the dispensing circuit, the injection arrangement of the supply circuit should be suitably washed after each dispensing operation, due to hygienic reasons, and to not compromise the organoleptic properties of a beverage dispensed at a later moment.

The known capsules disclosed above allow to obtain a final product by percolation of the liquid through the initial product (typically, coffee) or by solubilization or dissolution of the initial product (for example, tea, infusions, etc.). In the latter case, the initial product has to be easily and quickly soluble, so as to avoid the formation of clots or lumps inside the capsule and/or in the fruition container.

In fact, due to the speed and the dispensing manner of the liquid inside the capsule, it is very difficult, and almost impossible, suitably dissolving products that are not much or slowly soluble and/or containing thickeners to obtain, in the fruition container, dense and meaty (for example chocolate) or viscous final products.

As it is known, such final products may be obtained starting from a product in powder or granules, soluble or freeze-dried or dehydrated, only manually by gradually adding the liquid and continuously mixing the mixture until obtaining the final product. Therefore, such products cannot be obtained automatically using the known capsules and brewing machines.

SUMMARY OF THE INVENTION

An object of the present invention is to improve the known capsules for beverages or fluid food products, in particular sealed, disposable and single-dose capsules containing a soluble or freeze-dried or dehydrated product suitable to interact with a fluid, typically hot pressurized water, to prepare a corresponding final product in an automatic brewing machine.

Still another object is to obtain a capsule allowing obtaining in a brewing machine, automatically and without the manual intervention of a user, dense and meaty (for example, chocolate) or viscous final products perfectly dissolved and free from clots and lumps, obtained starting from initial products not much or slowly soluble and/or containing thickeners and/or stabilizers.

A further object is to manufacture a hermetic and sealed capsule, of the perforable type, and capable of dispensing a final product directly into a fruition container (cup, glass, etc.).

Still another object is to obtain a capsule allowing not to contaminate or pollute with the initial product and/or with the final product parts of the brewing machine, thereby ensuring both the hygiene and the cleanliness of the latter, and the taste and quality, i.e., the integrity of the organoleptic properties, of the final product.

A still different object is to obtain an extremely versatile capsule, capable of meeting the tastes of multiple different consumers, while keeping the initial product contained therein unaltered.

A further different object is to obtain a capsule capable of dispensing a final product into a fruition container (cup, glass, etc.) allowing a user separating in a simple manner components in recyclable plastics of which the capsule is made, from non-recyclable components such as, for example, multilayered polylaminates containing aluminum.

These objects and still others are achieved by a capsule according to one or more of the claims set out below.

BRIEF DESCRIPTION OF THE DRAWINGS

The invention can be better understood and implemented with reference to the attached drawings, that illustrate some embodiments thereof by way of non-limiting example, in which:

FIG. 8 is a perspective view of the mixing element in FIG. 6;

FIG. 9 is a cross-section of the capsule in FIG. 1 in a dispensing step of the final product;

FIG. 18 is a cross-section of a version of the capsule in FIG. 1, in which a solid product is present in a second duct;

FIG. 19 is an enlarged detail of a different version of the capsule in FIG. 1, comprising an interaction arrangement for interacting with the final product B contained in the second duct.

DETAILED DESCRIPTION OF THE INVENTION

Herein below, the same elements will be indicated by the same numerals in the various Figures.

Figure 16:
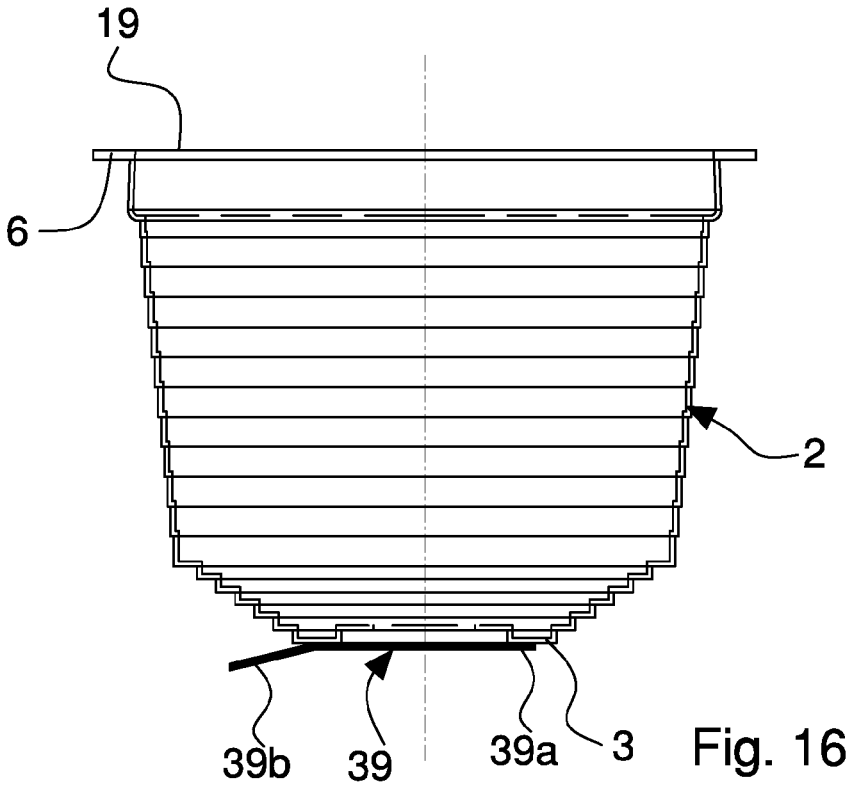
FIG. 16 is a side view of the capsule of the invention, comprising a closing element provided with a tab.
Figure 17:
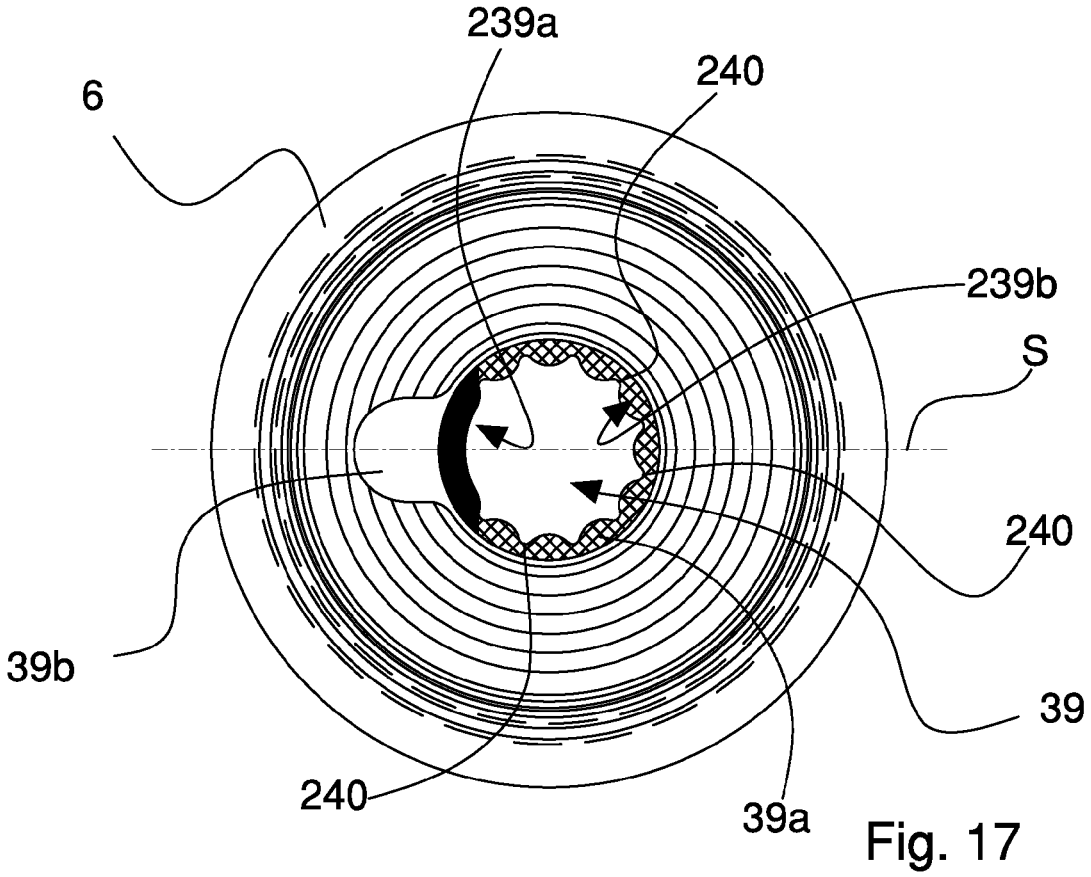
FIG. 17 is a bottom view of the capsule in FIG. 16.

With reference to the FIGS. 1 to 9 and to the FIGS. 16 and 17, a capsule 1 according to the invention is illustrated, containing an initial product P and usable in an automatic brewing machine to produce, by injection of a pressurized fluid therein, a final product B, for example, a beverage, such as coffee, barley, tea, etc.

The initial product P is, for example, a soluble or freeze-dried or dehydrated food product.

The capsule 1 comprises an external casing 2, or container, substantially in the shape of a glass or a cup, provided with a base wall 3 and with a side wall 4, defining a cavity 5 which is open and suitable to contain the initial product P from which the final product B can be obtained.

The casing 2 is compressible and/or crushable and/or deformable, obtained by forming of a thermoformable material sheet, in particular a liquid- and gas-impermeable multi-layered plastics and suitable for contact with foodstuffs.

To allow the casing 2 to be compressed and crushed along a direction A almost parallel to a longitudinal axis of the capsule 1 and substantially orthogonal to the base wall 3, the side wall 4 is deformable and/or compressible along preset pliability lines, for example, having a helicoidal trend, or it is made in the shape of an accordion or of a bellows, as in the embodiment illustrated in FIG. 16.

Furthermore, the side wall 4 is divergent starting from the base wall 3 to a peripheral flange-shaped edge 6, for example, having an almost frusto-conical shape.

The base wall 3 is, for example, concave in the direction of the cavity 5.

The capsule 1 comprises a nozzle 7 associated with the casing 2 arranged to introduce a fluid F into the cavity 5, in particular a pressurized hot liquid, for example water or milk, capable of interacting with the initial product P to obtain the final product B.

The nozzle is provided with at least one outflow opening 11 arranged to introduce a fluid flow F into the cavity 5 in a preparation step of the final product B.

The capsule 1 also comprises a mixing element 20 rotatably coupled to the nozzle 7 at the outflow opening 11 and so shaped as to divert the exiting fluid and be rotated by the latter about the nozzle 7, so as to create inside said cavity 5 a vortex flow of fluid F and initial P and final B product.

The nozzle 7 and the mixing element 20 are made of plastics, in particular by injection molding.

The mixing element 20 comprises a central portion 21, or hub, rotatably connectable to a connecting portion of the nozzle 7, in an assembled configuration W, and at least one blade 22 fixed to the central portion 21 and extending from the latter substantially radially outwardly. The central portion 21 has an annular shape, and it is rotatably and co-axially mounted on the nozzle 7.

In the illustrated embodiment, the mixing element 20 comprises a pair of opposite blades 22, i.e. spaced apart by 180° with respect to a rotation axis Y of the mixer 20, said rotation axis substantially coinciding with a longitudinal axis X of the nozzle 7. The mixing element 20 that may rotate freely and idle about the rotation axis Y forms a kind of propeller or rotor capable of moving and mixing the fluid F and the initial product P.

Each blade 22 has an elongated shape and extends from the hub 21 radially outwardly.

In the illustrated embodiment, each blade 22 has an arched shape and comprises a shaped portion 22*a* having a concave shape intended to intercept the jet L exiting the nozzle 7.

The hub 21 comprises a through hollow 24 arranged to house, contain, and engage with the connecting portion of the nozzle 7. The hub 21 further comprises at least one supplying opening 23 obtained transversally on a tubular wall thereof, connected to the outflow opening 11 in the assembled configuration W and arranged to convey a respective jet L of fluid F, or a portion thereof, exiting the latter towards the shaped portion 22*a* of the respective blade 22. In particular, the hub comprises a supplying opening 23 for each blade 22.

Therefore, the shaped portion 22*a* intercepts the jet L of fluid F coming from the supplying opening 23.

The supplying openings 23 in the assembled configuration W face a supplying groove 12 of the nozzle 7 which is flowingly connected with the outflow opening 11. In such a manner, the supplying groove 12 receives the flow of fluid F from the latter and acts as a supply manifold of the above-mentioned fluid F for the supplying openings 23 of the mixing element 20. The fluid flow exiting the outflow opening 11 is then divided into two jets L exiting uniformly and continuously the supplying openings 23 during the rotation of the mixing element 20. The jets L exert a thrust on the blades 22 such as to rotate the mixing element 22.

A locking arrangement 15, 25 is provided to elastically and reversibly restrain the mixing element 20 to the nozzle 7 in the assembled configuration W, in any case allowing the free rotation thereof about the rotation axis Y.

In the illustrated embodiment, the locking arrangement comprises one or more stop teeth 25, for example six in number, obtained on the hub 21 and arranged to elastically engage in a stop groove 15 obtained on the nozzle 7 and adjacent to the supplying groove 12. The stop teeth 25 obtained on an edge of the hub 21 are arranged mutually angularly spaced apart. Each stop tooth 25 comprises an abutting end 25*a*, intended to insert in the stop groove 15 and provided with a pair of planes that are tilted with respect to the rotation axis Y. Such tilted planes allow, by virtue of the elasticity of the plastics of the nozzle 7 and of the mixing element 20, rotatably coupling the mixing element 20 to the nozzle 7 in an assembling step of the capsule 1 and uncoupling the mixing element 20 and allowing it to slide along the nozzle 7, in a dispensing step of the final product B, as best explained in following of the description.

The dimensions, shape, inclination, number and arrangement of the blades 22 of the mixing element 20 may be suitably selected as a function of the type and composition of the initial product P.

Figure 5:
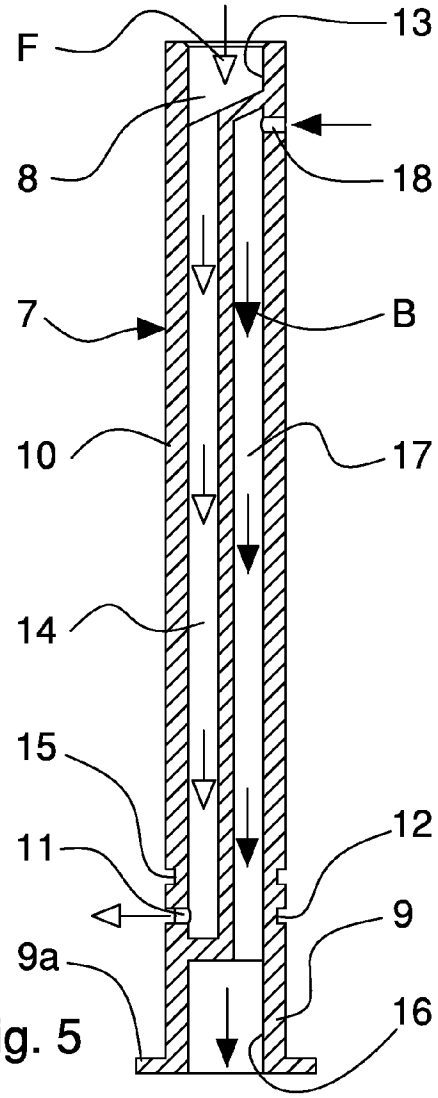
FIG. 5 is a cross-section of a nozzle of the capsule in FIG. 1.

With particular reference to FIG. 5, the nozzle 7 comprises an elongated and rigid tubular element, having a longitudinal side wall 10, a first end 8, and a second end 9 mutually opposite. The first end 8 is provided with a first opening 13 arranged to engage with an injection arrangement of a brewing machine capable of dispensing the fluid F, while the longitudinal side wall 10 is provided with the outflow opening 11 that is flowingly connected, via a first duct 14, to the first opening 13 and it is arranged to introduce the fluid F into the cavity 5 in an injecting step J, as best disclosed in the following description.

The second end 9 is provided with a second opening 16 flowingly connected via a second duct 17 with a dispensing opening 18 obtained on the longitudinal side wall 10 of the nozzle 7. As best explained herein below, the dispensing opening 18, the second duct 17, and the second opening 16 allow the final product B exiting the cavity 5 and being dispensed directly into a fruition container when the casing 2 is compressed and/or crushed.

The first duct 14 and the second duct 17 are placed side by side, in particular, they are parallel to one another and to a longitudinal axis X of the nozzle 7, and extend substantially over the entire length of the nozzle 7. The outflow opening 11 is obtained in the proximity of the second end 9, while the dispensing opening 18 is obtained in the proximity of the first end 8.

Figure 2:
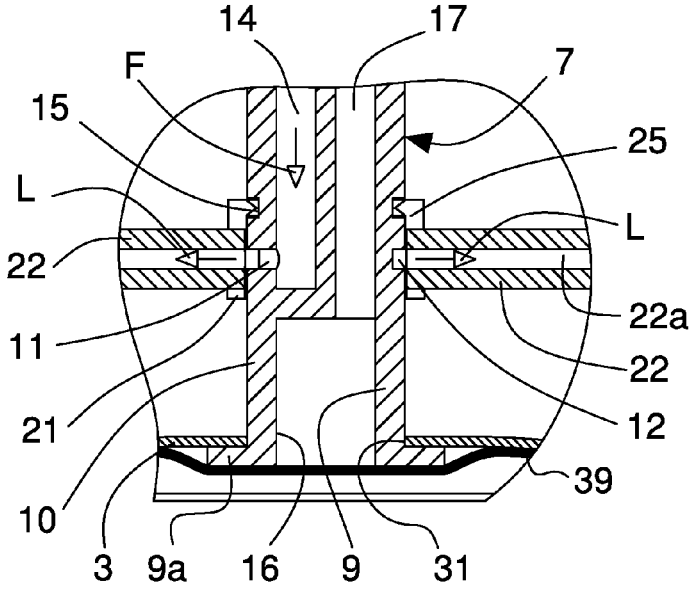
FIG. 2 is an enlarged detail of the capsule in FIG. 1.
Figure 4:
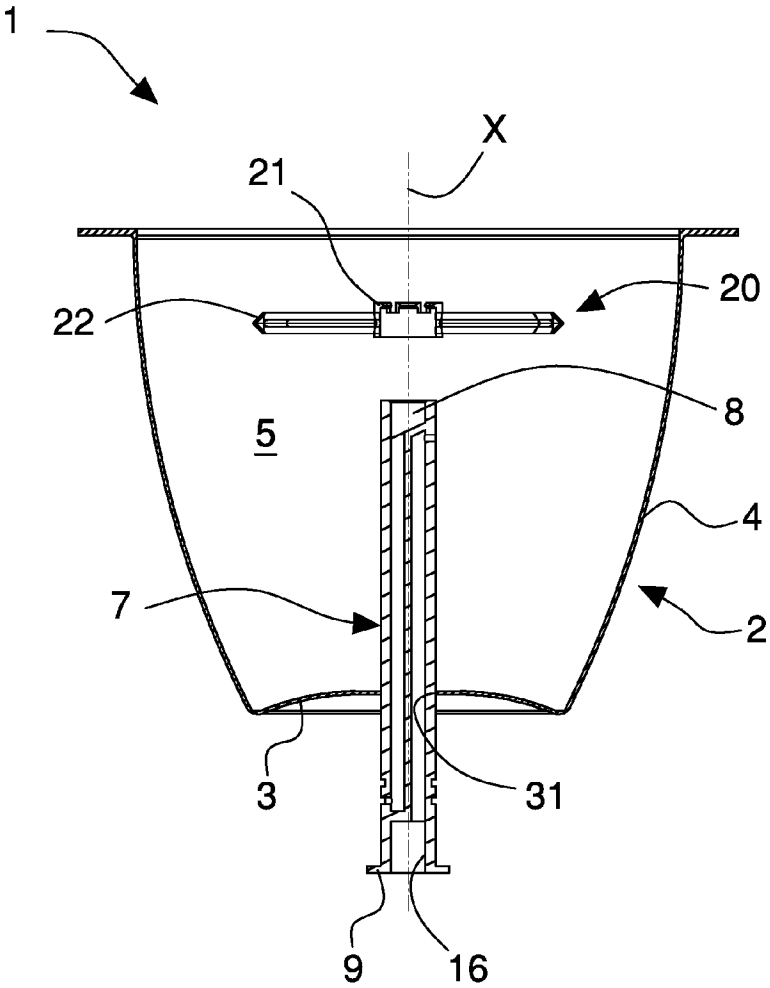
FIG. 4 is a cross-section of the capsule in FIG. 1 in a disassembled condition.
Figure 3:
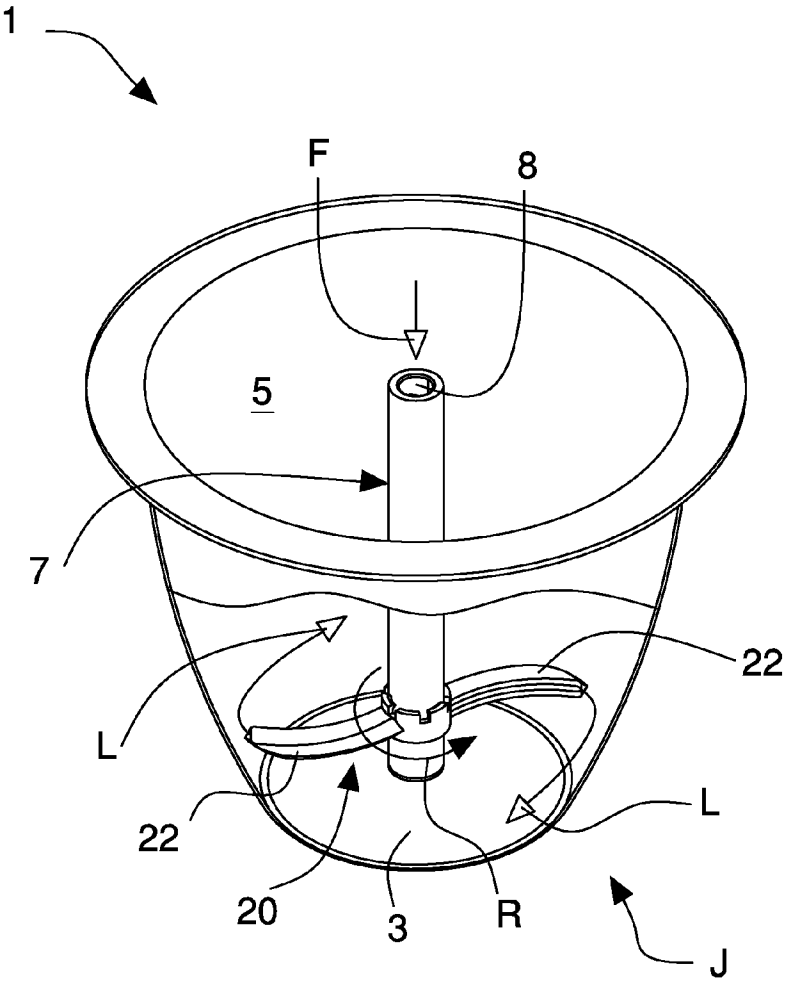
FIG. 3 is a perspective view of the capsule in FIG. 1 in an assembled condition and in a preparation step of the final product.
Figure 6:
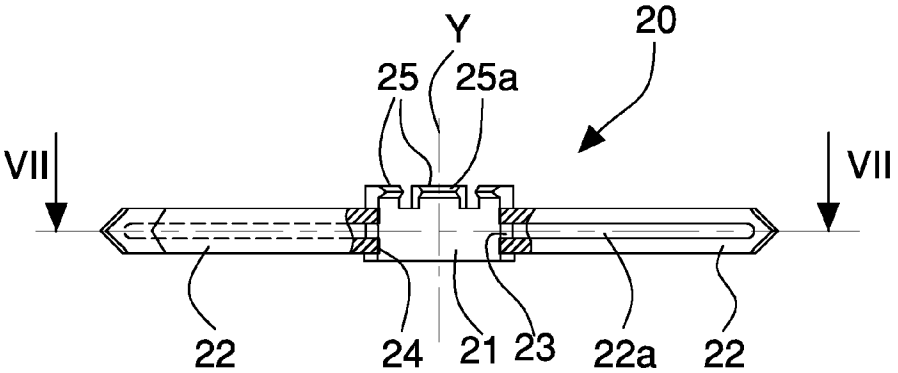
FIG. 6 is a cross-section of a mixing element of the capsule in FIG. 1.
Figure 7:
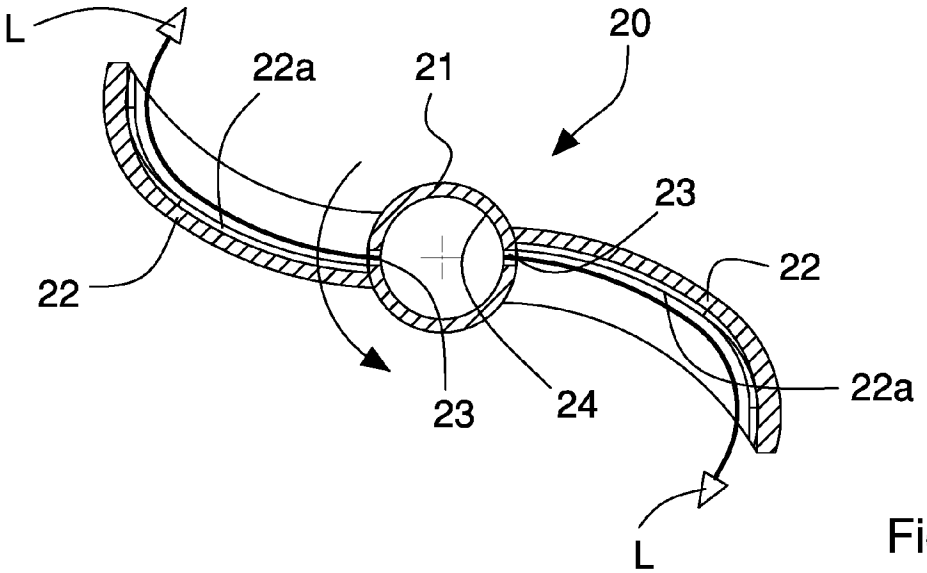
FIG. 7 is a cross-section according to line VII-VII in FIG. 6.

With particular reference to FIG. 2, in an initial configuration K of the capsule 1, in which the casing 2 is not compressed nor crushed, the nozzle 7 is arranged inside the cavity 5 with the second end 9 partially exiting the above-mentioned cavity 5 through an exit opening 31 obtained in the base wall 3. The nozzle 7 inserts and may slide with interference (thus making a hydraulic sealing) in the exit opening 31; in such a manner, as best explained in the following description, the final product B may exit the capsule 1 only through the nozzle 7, and in particular through the dispensing opening 18, the second duct 17, and the second opening 16.

The second end 9 of the nozzle 7 has a peripheral edge or also external flange 9*a* opposite the first end 8, which in particular peripherally surrounds the second opening 16. In the initial configuration K, the external flange 9*a* abuts against an external surface of the base wall 3.

A closing element 39 (FIGS. 16 and 17) is provided to hermetically close the second opening 16 of the nozzle 7 and insulating from the external environment the cavity 5. The closing element 39, for example in the shape of a disc, comprises a joining, for example annular, edge, 39*a* by which it is removably fixed to an external surface of the base wall 3. The closing element 39 may be easily detached from the base wall 3 in an automatic manner by the nozzle 7 in an initial partial crushing step of the casing 2, or again by the pressure of the air contained inside the cavity 5, which is in turn pushed to the outside by the introduction of the fluid F into the capsule during the injecting step J.

The closing element 39 may be further easily detached from the base wall 3 manually by a user before the insertion of the capsule 1 into the brewing machine, and in this case it is provided, according to a preferred embodiment, with an elongated tab 39*b* extending outwardly starting from a connecting portion of the joining edge 39*a*.

The closing element 39, provided with or devoid of the tab 39*b*, is made of plastics, or aluminum, weldable, for example thermally or by ultrasounds, and the joining edge 39*a* is, in particular, fixed to the external surface of the base wall 3 by a first portion 239*a* by a blocking seal and by a second portion 239*b* by a peelable seal, the blocking seal requiring a greater force compared to the peelable seal to release the joining edge 39*a* from the base wall 3, so as to promote the release of the second portion 239*b* of the joining edge 39*a* before releasing the first portion 239*a*.

The first portion 239*a* extends in a first angular interval comprised between 80° and 100°, in particular preferably 100°, and the second portion 239*b* extends in a second angular interval that is explementary to the first angular interval, in other words, the first portion 239*a* and the second portion 239*b* extend over the entire joining edge 39*a*.

If the closing element 39 is provided with the elongated tab 39*b*, the connecting portion of the joining edge 39*a* extends from the first portion 239*a* fixed by the blocking seal, due to reasons that will be best seen herein below.

The second portion 239*b*, fixed by a peelable seal, comprises a detachment promoting arrangement to promote a gradual and progressive separation of the joining edge 39*a* from the base wall 3, which comprise at least one detachment portion 240, at which the second portion 239*b* has substantially a "V", or wedge, shape.

Figure 12:
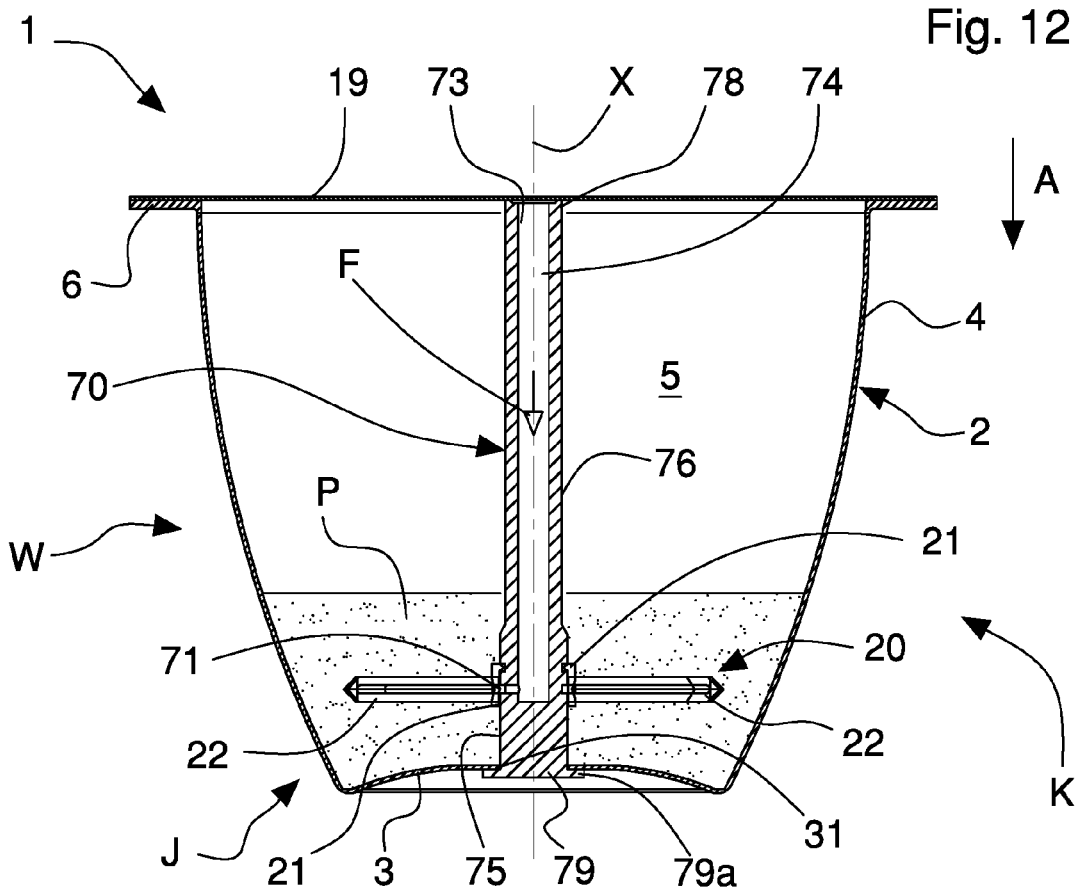
FIG. 12 is a cross-section of a version of the capsule according to the invention in an assembled condition.

Preferably, the detachment promoting arrangement comprises a plurality of detachment portions 240 angularly equidistant in the second portion 239*b*, as shown in FIG. 12, to distribute the efficiency of such release along the entire second portion 239*b*.

On the contrary, the first portion 239*a* fixed by the blocking seal is devoid of the detachment promoting arrangement, and, therefore, although both the blocking seal and the peelable seal allow removably fixing the closing element 39 to the base wall 3, the blocking seal requires a greater force compared to the peelable seal to allow the release of the first portion 239*a* with respect to the second portion 239*b*.

If the tab 39*b* is present, and only one detachment portion 240 (not illustrated) is present, the latter is located in the second portion 239*b* along a symmetry axis S of the tab 39*b*, on the opposite side with respect to the tab 39*b*.

In this manner, when the closing element 39 is pushed by the nozzle 7 and detached in an automatic manner, the first portion 239*a* remains connected to the base wall 3 and acts as a hinge element about which the portion of the closing element 39 comprising the second portion 239*a* of the joining edge 39*a* may rotate, away from the base wall 3.

According to a non-illustrated embodiment, the closing element 39 may be removably fixed to the external flange 9*a* so as to hermetically close the second opening 16. In this case, the closing element has to be manually detached by the user before inserting the capsule 1 into the brewing machine.

The capsule 1 further comprises a covering element 19 that may be fixed to the edge 6 of the casing 2 to hermetically close the cavity 5. The covering element 19 is perforable, in particular by the injection arrangement of a brewing machine, to introduce the fluid F into the nozzle 7. The covering element 19 is fixed by means of a welding also to the first end 8 of the nozzle 7, collaborating with the exit opening 31 to keep the above-mentioned nozzle 7 in place inside the cavity 5, and above all creating a fluid seal between the covering element 19 and the above-mentioned first end 108. In this manner, the fluid F received from the nozzle 7 in the first opening 13 is dispensed to the containing cavity of the product P only through the outflow opening 11 and undesired leaks of the fluid F at the first end 8 are avoided.

Both the closing element 39 and the covering element 19 are made of selected materials, for example, multilayered plastic polylaminates, so as to protect over time from moisture and oxygen the initial product P contained in the capsule. Such multilayered plastics may for example contain aluminum or a different barrier layer, for example, ethylene vinyl alcohol (EVOH) or polyvinylidene chloride (PVDC). If they contain, for example, aluminum, they cannot be considered as recyclable plastics, therefore they have to be divided from the remaining plastics composing the capsule to the aims of waste disposal.

The operation or use of the capsule 1 of the invention in an automatic brewing machine provides for an initial step of partial crushing of the casing 2 to allow the nozzle 7, slidable with interference in the exit opening 31, further exiting the latter, at least partially detaching the closing element 39. In fact, the portion of the closing element 39 comprising the second portion 239*b* rotates away from the base wall 3 about the first portion 239*a*, still connected to the base wall, acting as a hinge line of the closing element 39.

The detachment, even if partial, of the closing element 39 puts the cavity 5 flowingly connected with the external environment, through the dispensing opening 18, the second duct 17, and the second opening 16. In this manner, the air contained inside the capsule 1 may freely exit when, in the successive injecting step J, the fluid F is introduced into the cavity 5 through the outflow opening 11 of the nozzle 7. The nozzle 7 exits the capsule 1 by a reduced amount, so as to ensure that the outflow opening 11 remains anyhow inside the cavity 5 to introduce the fluid F inside the latter.

The nozzle 7 is supplied by the injection arrangement of the brewing machine capable of perforating the covering element 19 and engaging the first opening 13.

Alternatively, the closing element 39 may be manually removed by the user before inserting the capsule 1 into the brewing machine. In this case, the casing 2 needs not to be partially compressed and crushed before and/or during the injecting step J of the fluid F.

In the injecting step J (FIG. 3), the fluid F introduced by the nozzle 7, and in particular through the outflow opening 11 of the nozzle 7 and through the supplying openings 23 of the mixing element 20, may interact with the initial product P to gradually form the final product B. In this step, the casing 2 of the capsule 1 is partially crushed (to allow the nozzle detaching the closing element 39) and the second end 9 of the nozzle 7 is engaged, seal fit in the exit opening 31. Since the dispensing opening 18 is in the proximity of the first end 8 of the nozzle 7, the fluid F, the mixture of fluid and initial product P, and the final product B progressively forming on the bottom of the capsule 1, cannot exit externally to the latter through the second opening 16.

The jets L of fluid exiting the supplying openings 23 hit the blades 22 of the mixing element 20 rotating the latter about the rotation axis Y. Meanwhile, the jets L are diverted, by virtue of the shape of the blades 22 and the shaped portions 22*a* of the latter ones, in a direction substantially tangential with respect to the rotation axis Y with an opposite direction to the of rotation direction R of the mixing element 20.

The mixing element 20 and the jets L create in the cavity 5 a vortex flow of fluid F and initial product P, progressively mixed, which from the base wall 3 goes upwards, i.e., towards the edge 6 of the casing 2.

In particular, the initial product P is moved and mixed with the fluid F gradually and progressively with the introduction of the latter inside the cavity 5. In other words, the mixing procedure that is obtained with the capsule 1 of the invention is similar to the optimum manual procedure providing for gradually adding the fluid to the initial product and mixing continuously the mixture adding fluid until obtaining the final product.

It is worth noting that in this manner it is possible to solubilize and dissolve completely and homogeneously, without the manual intervention of a user, products not much or slowly soluble and/or containing thickeners and/or stabilizers or freeze-dried or dehydrated products so as to obtain dense or viscous final products that are perfectly dissolved and free from clots and lumps (for example, chocolates).

The pressure and temperature of the fluid F introduced into the cavity 5 have to be suitably adjusted as a function of the type and composition of the initial product P.

To allow the complete dissolution and/or solubilization of the initial product P, it is further necessary that the cavity 5 of the capsule 1 is filled with the amount or volume of fluid F necessary before the dispensing step.

Once the cavity has been completely filled with the fluid F interacting with the initial product P to form the final product B, it is possible to dispense the latter in a dispensing step E directly into a fruition container that is suitably arranged.

The dispensing step may be implemented by progressively compressing and crushing the casing 2 along the direction A so as to allow the nozzle 7 to further exit the cavity 5 through the exit opening 31, and moreover so as to force the final product B to exit the cavity 5 through the dispensing opening 18, the second duct 17, and the second opening 16. Since the longitudinal side wall 10 of the nozzle 7 abuts against and sealingly slides in the exit opening 31, and since the cavity 5 is closed, crushing and compressing the casing 2 the final product B contained therein is in fact forced by the pressure to enter the dispensing opening 18 and exit the capsule 1 through the second duct 17 and the second opening 16, directly in the fruition container.

It shall be noticed that, in the case of in particular dense or viscous final products B, the exit thereof from the capsule 1 is obtained just by virtue of the progressive compression and crushing of the casing 2.

The locking arrangement 15, 25 allow the mixing element 20, pushed by the base wall 3, uncoupling from the nozzle 7 and sliding along the latter towards the first end 8 so as to allow the compression and crushing of the casing 2.

When the outflow opening 11 of the nozzle 7 is outside of the capsule 1, during the progressive crushing of the casing 2 and the consequent progressive exit of the nozzle 7, it is further possible to dispense directly into the fruition container also the fluid F. More precisely, the nozzle 7 allows dispensing at the same time the fluid F (through the first duct 14 and the outflow opening 11) and the final product B (through the second duct 17 and the second opening 16) so as to further dilute the latter and to obtain a desired dose of final product.

Such operation, which with the known capsules has to be implemented manually by the user, may be instead carried out in an automatic manner by the brewing machine using the capsule 1 of the invention.

It shall be noticed that the capsule 1 of the invention allows dispensing into the container only the final product B (during the dispensing step E) at the end of the solubilization and/or dissolution thereof. In fact, the configuration of the nozzle 7 prevents the exit also accidental of the fluid F from the capsule 1 during the preparation step of the final product B.

Alternatively, the dispensing step E may be initially carried out by continuing injecting the fluid F into the cavity 5, thus forcing the final product B to exit due to the action of the pressure from the capsule 1. Subsequently, by completely compressing and crushing the casing 2, the complete outflow of the final product B from the capsule is obtained. It shall be noticed that also with such dispensing manner, it is possible to dilute the final product B and obtain a desired final amount thereof that is greater than the capsule capacity. Such operation, which with the known capsules has to be carried out manually by the user, may be instead carried out in an automatic manner by the brewing machine using the capsule 1 of the invention.

At the end of the dispensing operation, a user may manually complete the removal of the covering element 19 (and to such aim, in a non-illustrated embodiment, the covering element could also be provided with an elongated tab) and/or of the closing element 39, in order to separate components in recyclable plastics, as surely the casing 2 and the nozzle 7 are, from non-recyclable components, as could be the covering element 19 and/or the closing element 139, if they are made in a multilayered plastics containing for example aluminium.

As regards the closing element 39, the user may separate it from the capsule 1 by grasping the portion already detached of the closing element 39 comprising the second portion 239*b* or the user may, if present, grasp the tab 39*b* connected to the first portion 239*a* of the joining edge 39*a* thus avoiding getting contaminated and/or wetted in case the above-mentioned already detached portion contacted during the dispensing operation the final product B.

Figure 1:
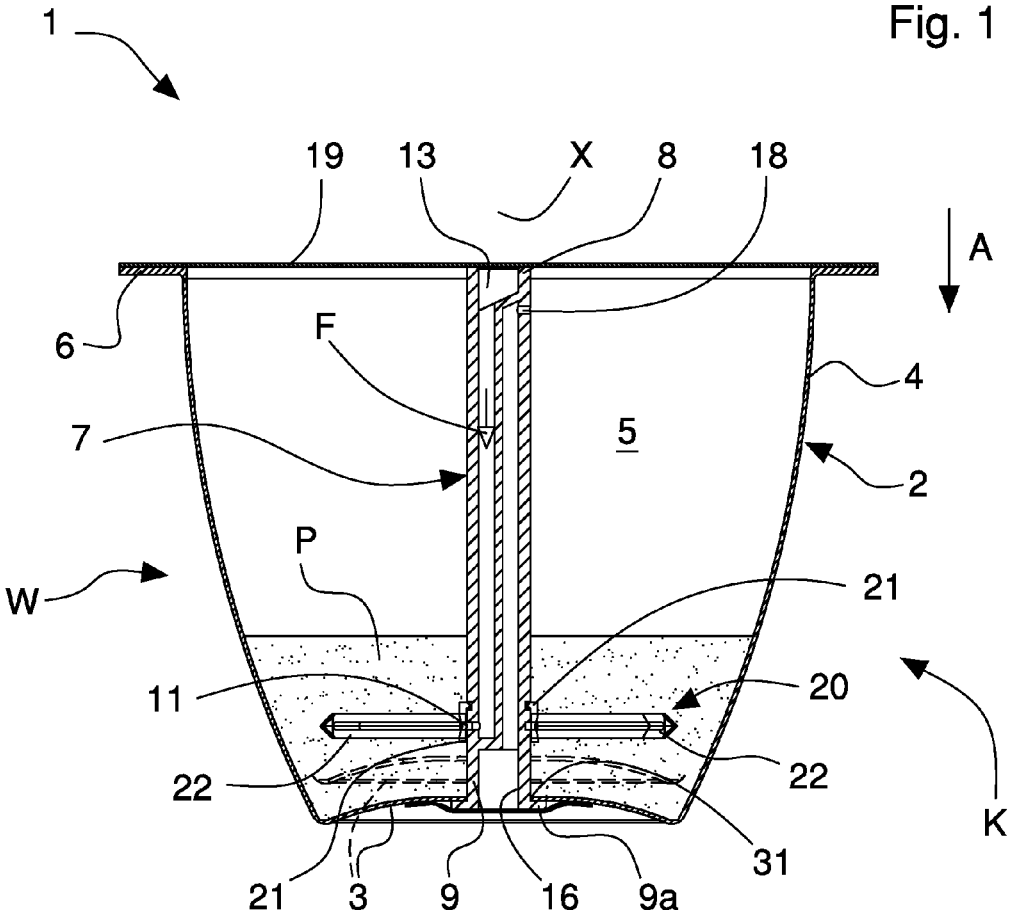
FIG. 1 is a cross-section of the capsule for beverages according to the invention in an assembled condition.

FIG. 18 illustrates a further version of the capsule 1 differing from the capsule in FIG. 1 in that it comprises a solid product UP, schematically illustrated, contained in the second duct 17 and dispensable directly into a fruition container through the second opening 16 before the dispensing step E.

The solid product UP may be soluble or not soluble, and it is intended to be consumed together with the final product B.

The solid product UP may be composed of only one element (for example, a cookie, or a crouton or a piece of bread), or by a plurality of elements, such element(s) having at least one dimension (length, width, or height) that is greater than, or the same as, a width of the dispensing opening 18, so that the dispensing opening 18 prevents such solid product UP exiting the second duct 17 towards the cavity 5. In such a manner, the solid product UP remains inside the second duct 17 separated from the initial product P all the time that the capsule 1 remains unused.

In particular, the solid product UP may comprise multiple elements that are homogenous to each other, i.e., of the same type, such as, for example sweeteners, or cereals, colored or not, or croutons, and the like, or a plurality of elements that are mutually non-homogenous, for example, a mixture of sweeteners and cereals.

The solid product UP may be inserted into the capsule 1 at the production line, this reducing and simplifying a product storehouse. This further allows diversifying, in a packaging step, capsules 1 containing a same initial product P. In fact, in the packaging step it is possible to add to the capsules 1 containing a same initial product P, a plurality of different solid products UP. For example, it is possible to add to the capsule 1 containing a same product P, a solid product UP composed of a sweetener, or a solid product UP composed of cereals.

The operation or use of this version of capsule 1 in an automatic brewing machine is substantially similar to that of the capsule in FIG. 1 as regards the preparation of the final product B. In addition, the capsule in FIG. 1*b* allows using the solid product UP.

The solid product UP may be dispensed directly into the fruition container in an automatic manner. According to such manner, the step of partial crushing of the casing 2 allows the nozzle 7 at least partially detaching the closing element 39, so as to connect the second duct 17 to the external environment via the second opening 16, and allow the exit of the solid product UP from the second duct 17 towards the fruition container.

Alternatively, the solid product UP may be dispensed directly into the fruition container in a manual manner. According to such manner, the closing element 39 is manually detached from the base wall 3 by a user before inserting the capsule 1 into the brewing machine. The user, at discretion, may determine the amount of solid product UP to be dispensed into the fruition container, for example, in the case that the solid product UP is a sweetener, to obtain a sweeter or less sweet final product B. Of course, in a manual manner, the user may also decide not to use the solid product UP at all. In this case, the user has only to remove the solid product UP from the second duct 17 without inserting it into the fruition container.

FIG. 19 illustrates a further version of the capsule 1 differing from the capsule in FIG. 1 in that it comprises an interaction arrangement for interacting with the final product B contained in the second duct 17, to further vary organoleptic or visual characteristics of such final product B before the dispensing into the fruition container.

Such interaction arrangement comprises a vortex flow generating member and/or a perforated member (not illustrated), the latter to perform a filtering function or, alternatively, to reduce or eliminate possible froth present in the final product B.

The vortex flow generating member comprises an elongated and rigid tubular-shaped insert 528 having a longitudinal side wall 529 provided with a helicoidal projection 530 extending longitudinally at least along a portion of said insert 528, preferably along the entire insert 528. The insert 528 is contained in the second duct 17 and creates an annular gap 531, between a smooth wall 532 of the second duct 17 and said side wall 529 provided with the projection 530. The annular gap 531 has channels with a helicoidal trend, to generate the vortex flow of fluid into the annular gap. In this manner, the final product B, before being dispensed into the fruition container, is rotated and forced to flow with a vortex motion into the annular gap 531. The final product B is further mixed, thus the complete and homogeneous solubilization of products not much or slowly soluble is further promoted. The vortex motion may, in addition or alternatively, promote the formation of froth in the final product B, if desired. The insert 528 further comprises end projections 533 allowing holding the same insert 528 in place inside the second duct 17 by interference. Between a projection 533 and the other one, dispensing passages of the final product B are defined.

The projection 530 illustrated in FIG. 1*b* has a longitudinal extent such as to be in the shape of a band, with coils tilted by 30° with respect to a longitudinal axis of the insert 528. The projection 530 may be also made in the shape of a thread (not shown). The pitch of the coils, the longitudinal extent of each coil, which dictates whether the projection is in the form of a band or a thread, and the thickness of the projection 530 in the perpendicular direction to the longitudinal axis of the insert 528 determine the rotation in the fluid and therefore they are selected based on the type of final product B to be obtained.

The perforated member may be for example obtained as an insert in the shape of a micro-perforated disc, or as a hollow tubular insert with opposite micro-perforated head walls, arranged in the second duct 17 and held in place by interference, to perform a filtering function and avoiding the exit of fragments of the initial product P into the fruition container that are possibly present in the final product B.

Alternatively, the perforated member may comprise an insert provided with a large mesh net to reduce or avoid a possible froth present in the final product B when the froth is not required for the particular final product B to be dispensed.

The vortex flow generating member and the perforated member may be present alternatively in the second duct 17.

However, the vortex flow generating member and the perforated member may be present also at the same time in the second duct 17, if, for example, the final product B requires a further mixing to promote a complete solubilization of the initial product P, while the reduction of the possible froth created by the vortex flow before the dispensing into the fruition container is desired.

Such interaction arrangement is inserted in the second duct 17 in the production line, this reducing and simplifying a product storehouse.

The operation or use of this version of capsule 1 in an automatic brewing machine is substantially similar to that in FIG. 1, but, in addition, the final product B is further mixed and/or filtered and/or froth in it is created/avoided. Therefore, some qualitative characteristics of the final product B are changed in a simple and efficient manner, without the need for modifying the type of capsule to be produced.

It is worth noting that the capsule 1 of the invention allows dispensing the final product B directly into a fruition container without the need to be perforated below. Compressing and crushing the capsule 1, i.e., the casing 2, the nozzle 7 passing through the outflow opening 31 of the base wall 3, allows the controlled exit of the final product B through the dispensing opening 18 and the second opening 16 directly in the fruition container.

Therefore, the capsule 1 of the invention may be used on a brewing machine not provided with a dispensing circuit, since such capsule does not require an extracting arrangement suitable to perforate the bottom of the capsule to allow the exit of the final product, nor a duct arrangement to convey such final product into the fruition container (for example, a mug, a cup, a glass, etc.).

The absence of the dispensing circuit makes the brewing machine simpler and inexpensive, and it further ensures the hygiene of the dispensing process and the maintenance of the quality of the dispensed beverages, since contaminations between beverages dispensed at later moments are not possible.

Another advantage of the capsule 1 of the invention is that it prevents that the injection arrangement of the brewing machine contacts the initial product P and/or the mixture/final product B in the preparation step and, subsequently, in the dispensing step. In fact, the nozzle 7 of the capsule 1 is arranged to be engaged, by the first opening 13 of the first end 8, by the injection arrangement of the brewing machine. In such a manner, also by virtue of the covering element 19, the injection arrangement, also when they are inserted in said first opening 13 are separated and insulated from the cavity 5 and the initial product P. Thus the supply circuit of the machine, comprising the injection arrangement, is not contaminated or polluted by the initial and/or final product, this ensuring the hygiene of the dispensing process and the quality of the final products at each dispensing operation.

A further advantage of the capsule 1 is that it does not require a special sealed package, since the base wall 3 and the nozzle 7 engaged in the outflow opening 31 hermetically insulate the cavity 5 from the external environment so as to preserve the initial product P.

Figure 10:
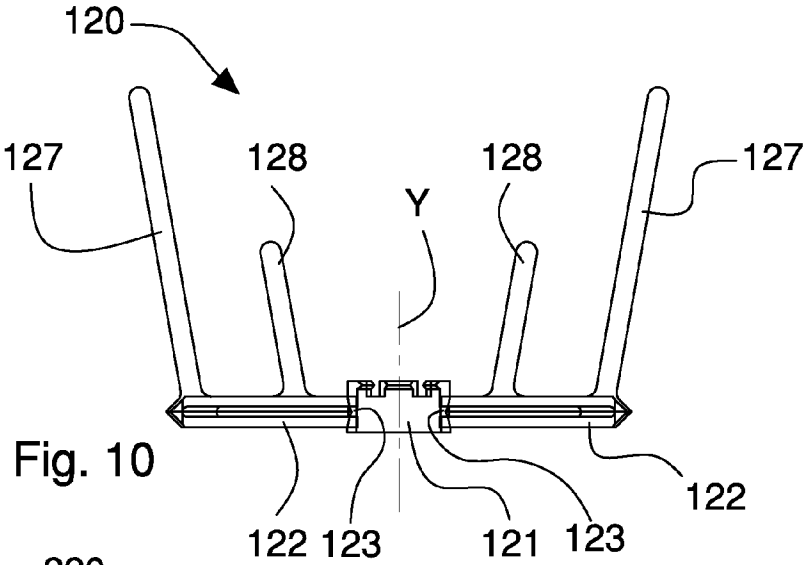
FIG. 10 is a front view of a version of the mixing element of the capsule.

FIG. 10 illustrates a version of the mixing element 120 that may be mounted in the capsule 1 of the invention. Such version differs from the version disclosed above in that it comprises respective blades 122, in which each blade 122 comprises a respective pair of elongated stems 127, 128 having a different height and fixed transversally to the abovementioned blade, tilted with respect to the rotation axis Y. The elongated stems 127, 128 concur to increase the vortex motion inside the cavity 5 during the introduction of the fluid F. They further determine a different trend and distribution of the fluid flow and the product generated by the rotation of the mixing element 120.

The mixing element 120 comprises two opposite blades 122 fixed to a respective central portion 121, or also hub of annular shape rotatably and co-axially mounted on the nozzle 7, which extend from the central portion 121 substantially radially outwardly, similarly to what has been stated for the mixing element 20. The hub 121 further comprises at least one respective supplying opening 123 obtained transversally on a tubular wall thereof, connected to the outflow opening 11 in the assembled configuration W.

Figure 11:
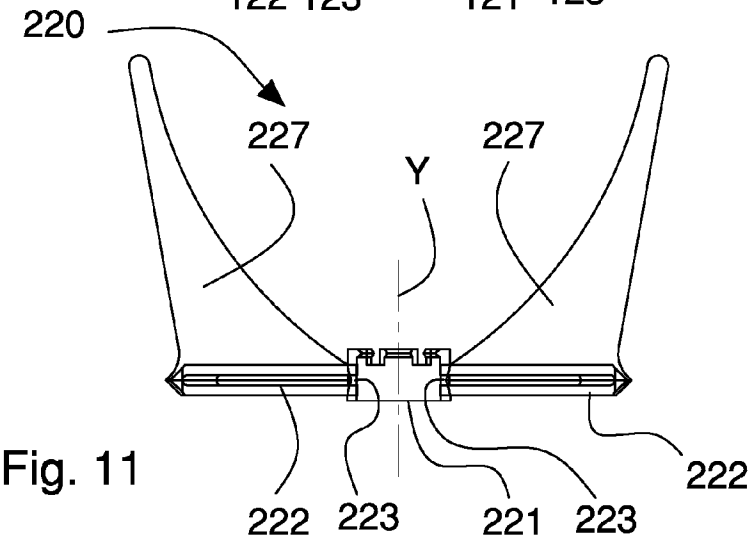
FIG. 11 is a front view of another version of the mixing element.

FIG. 11 illustrates another version of the mixing element 220, which may be mounted in the capsule 1 of the invention, differing from the versions disclosed above in that it comprises respective blades 222, in which each blade 222 comprises a respective flap 227 of triangular shape, fixed transversally, in particular orthogonally, to the above-mentioned blade. The base of the flap 227 is fixed over the entire length thereof to the blade 222. In this case also, the flap 227 increases and changes the vortex motion inside the cavity during the introduction of the fluid F.

The mixing element 220 comprises two opposite blades 222, fixed to a central portion 221, or hub of annular shape and rotatably and co-axially mounted on the nozzle 7. The hub 221 further comprises at least one respective supplying opening 223 obtained transversally on a tubular wall thereof, connected to the outflow opening 11 in the assembled configuration W.

FIG. 16 illustrates still another version of the mixing element 320, differing from the versions disclosed above in that it comprises respective blades 322 which comprise an elongated, rigid tubular element, fixed to a respective central portion 321 of annular shape and rotatably and co-axially mounted on the nozzle 7, having respective supplying openings 323, obtained in the tubular wall of the central portion 321, one for each blade 322.

Each tubular element is provided with an exit opening 326 arranged at an external end of the blade 322 and further comprises an internal duct 327 to direct the jet L of fluid F coming from the supplying opening 323 to the exit opening 326.

The exit opening 326 is obtained in a side wall of the blade 322 so as to eject a jet L of fluid F parallel to the base wall 3 of the capsule and transversally to a rotation axis Y of the mixing element 320, coinciding with the longitudinal axis X of the nozzle 7, tangentially to the blade 322 with respect to the rotation axis Y.

The exit openings 326 of each blade are on opposite side walls to direct the jets L of fluid in parallel, but opposite directions, so as to rotate the mixing element 320.

According to a different non-illustrated version of the mixing element in FIG. 16, each blade comprises a plurality of exit openings obtained in the side wall of the blade to eject a plurality of mutually parallel jets. The plurality of exit openings of each blade are on opposite faces to direct the jets of fluid L in parallel, but opposite, directions.

FIG. 17 illustrates a still further version of the mixing element 420, similar to the version in FIG. 16, differing from the latter in that it comprises respective elongated, rigid, tubular blades 422 fixed to a respective central portion 421 of annular shape and rotatably and co-axially mounted on the nozzle 7, having respective supplying openings 423, obtained in the tubular wall of the central portion 421, one for each blade 422. Each blade 422 has an end exit opening 426 obtained in the side wall of the blade 422 and a plurality of further exit openings 428 obtained in a bottom wall of the blade 422, each further exit opening facing the base wall 3 of the capsule 1. An internal duct 427 is arranged to direct the jet L of fluid F coming from the supplying opening 423 to the exit opening 426 and the further exit openings 428.

According to this version, the jet of fluid L ejected by the side exit opening 426 is parallel to the base wall 3 of the capsule, transversal to a rotation axis Y of the mixing element 420 and substantially tangential with respect to the rotation axis Y to rotate the mixing element 420 about the rotation axis Y. The jets of fluid L ejected by the further exit openings 426 instead face the bottom of the capsule 1.

In this manner, the exit opening 426 and the further exit openings 428 determine a vortex flow of fluid inside the cavity 4, with jets facing also the bottom promoting the solubilization of not much or slowly soluble products that are typically deposited undissolved on the bottom.

According to a different non-illustrated version of the mixing element in FIG. 17, each blade comprises a plurality of exit openings obtained in the side wall of the blade to eject a plurality of mutually parallel jets and a plurality of further exit openings facing the bottom of the capsule. This version is advantageous when it is desired to create a vortex flow of fluid with distributed jets.

Figure 14:
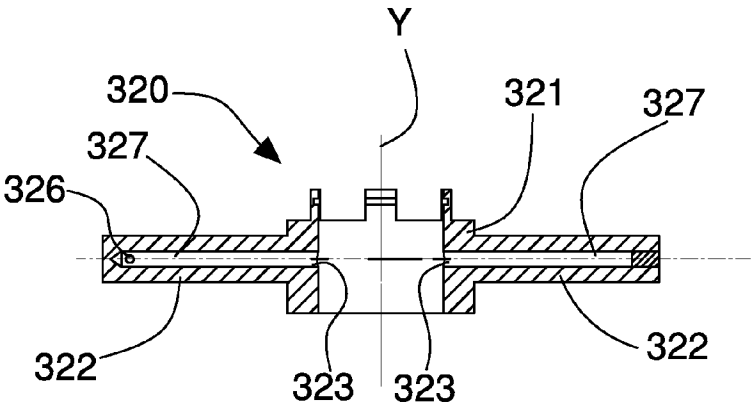
FIG. 14 is a cross-section of a version of the mixing element.
Figure 15:
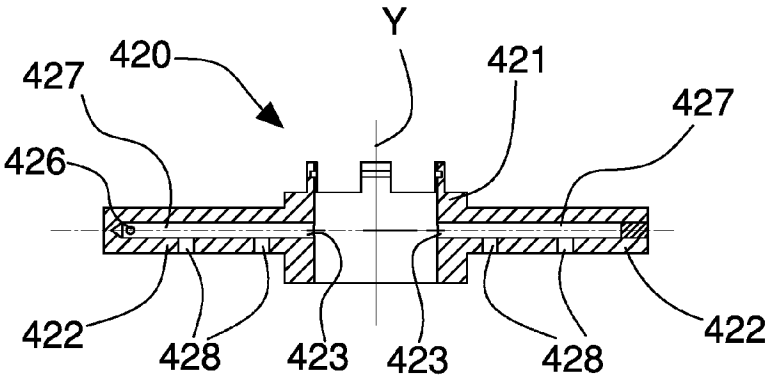
FIG. 15 is a cross-section of a further version of the mixing element.

It shall be noticed that the elongated stems 127, 128 shown in FIG. 10 or the flaps 227 shown in FIG. 11 may be applied to the mixing elements 320 and 420 shown in the FIGS. 14 and 15, or to versions not illustrated thereof, disclosed above.

One or more stop teeth 25, disclosed with reference to the mixing element 20 in FIG. 1, may be applied also to the mixing elements 120, 220, 320, and 420 shown in the remaining Figures.

Figure 13:
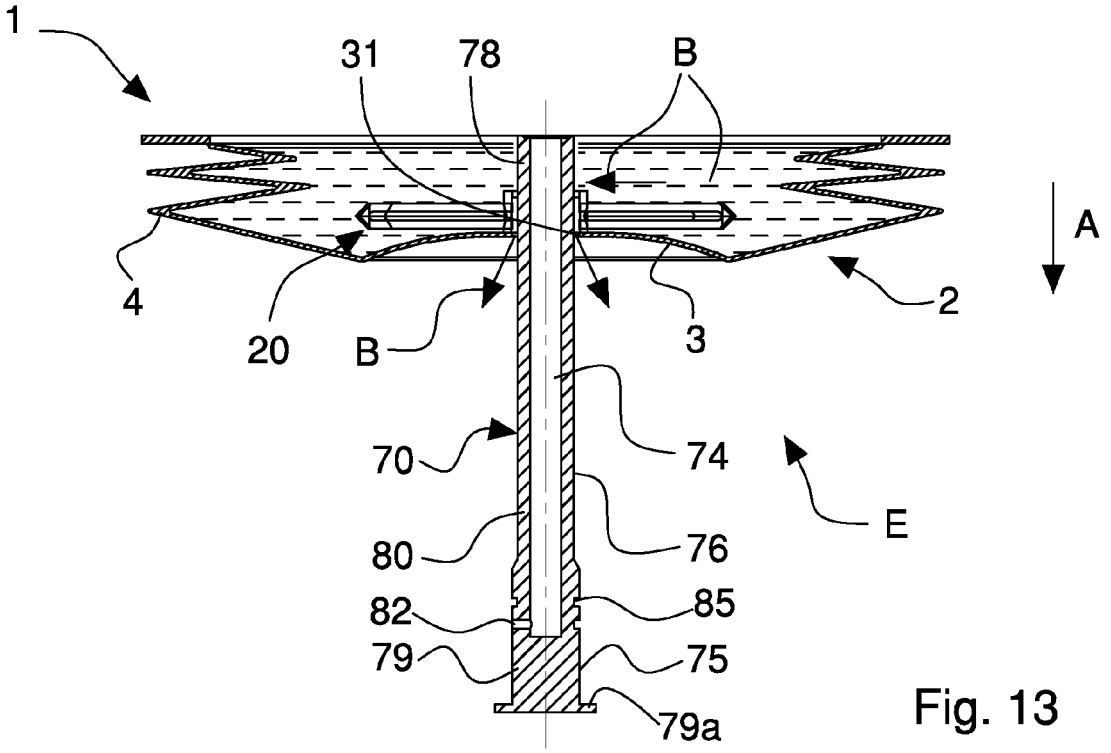
FIG. 13 is a cross-section of the capsule in FIG. 12 in a dispensing step of the final product.

FIGS. 12 and 13 illustrate a version of the capsule 1 differing from the embodiment disclosed above and shown in the FIGS. 1 to 9, in that the nozzle 70 comprises a respective rigid and elongated tubular element having a longitudinal side wall 80 provided with an outflow opening 71 and a first end 78 provided with a first opening 73 arranged to engage with the injection arrangement of a brewing machine capable of dispensing the fluid F, flowingly connected via a first duct 74 to the outflow opening 71. Such version of nozzle does not comprise dispensing opening, second duct, and second opening.

The nozzle further comprises a second end 79 having an external flange **79*a* opposite the first end 78. In the initial configuration K the external flange 79*a* abuts against an external surface of the base wall 3**.

The nozzle 70 is provided with a first portion 75 adjacent to the second end 79 and arranged to engage with interference and sealingly slide in the exit opening 31 of the base wall 3 so as to prevent the exit of the fluid and/or product from the cavity 5. The cross-sections of the nozzle 70, at the first portion 75, and of the exit opening 31 have a complementary shape.

The first portion 75 is provided with a respective stop groove 85 and a respective supplying groove 82, similar to those disclosed with reference to FIG. 1.

The nozzle 70 also comprises a second portion 76 adjacent to the first portion 75, interposed between the latter and the first end 78 and having a cross-section smaller than that of the first portion 75 and the exit opening 31 so as to allow the final product B exiting the cavity 5 through the above-mentioned exit opening 31, when in the dispensing step E the casing 2 is compressed and crushed until bringing the second portion 76 at the above-mentioned exit opening (FIG. 13). In such a manner, the beverage B contained in the capsule 1 may exit substantially by gravity and/or thrust by the compression and crushing of the capsule 1.

In the illustrated embodiment in the FIGS. 12 and 13, the second portion 76 has a substantially circular cross-section, as the one of the first portion 75, but with a smaller diameter, so as not to abut against the exit opening 31. The longitudinal side wall 80 of the nozzle 70 at the second portion 76 and the exit opening 31 form the passage through which the final product B may exit.

The shape of the cross-section of the second portion 76 may also be oval or polygonal, in any case, such as to make with the exit opening 31 a passage for the exit of the final product B.

The second portion 76 allows the free sliding along the nozzle 70 of the mixing element 20 towards the covering element 19 under the thrust of the base wall 3 during the compression and crushing of the capsule 1 in the dispensing step E.

It shall be noticed that in the injecting step J (FIG. 12) the cavity 5 has to be connected to the outer environment to allow the inlet of the fluid F and the concomitant exit of the air contained therein, for example, suitably perforating the covering element 19. To such aim, the brewing machine may be provided with a suitable arrangement for the perforation and exit of air.

In a version of the capsule not illustrated in the Figures, the base wall 3 of the capsule 1 comprises an edge or annular wall extending about the exit opening 31 and inside or outside of the cavity 5. The annular wall is intended to sealingly engage the longitudinal side wall 10 of the nozzle 7. The cross-sections of the nozzle 7 and of the annular wall are of a complementary shape.

Such version of the base wall 3 may be also applied to the version of the capsule 1 of the invention in FIGS. 12 and 13, but in such case the cross-sections of the first portion 75 of the nozzle 70 and of the annular wall are of a complementary shape.

In another version of the capsule not illustrated in the Figures, the base wall is closed, i.e., not provided with the exit opening 31, and it comprises, besides to the annular wall projecting outside of the cavity 5, a bottom wall connected to the annular wall so as to form a compartment suitable to partially house the second end 9 of the nozzle 7. The bottom wall is easily frangible from the second end 9 of the nozzle 7 when the casing 2 is compressed and crushed. To this aim, the bottom wall is obtained with a reduced wall thickness. Alternatively, the bottom wall may comprise a pre-incision line or a weakening portion, promoting the perforation by the nozzle 7.

In a non-illustrated version of the capsule 1, and with particular reference to the FIGS. 1 to 11, the external flange 9*a* of the nozzle 7 has an external surface which is provided with an annular groove with a triangular cross-section proximate to the second opening 16, which is suitable to direct the final product B when it exits the capsule 1 through the above-mentioned second opening 16. Such groove may aid in more accurately directing the final product B flow into the fruition container. Such annular groove may be implementable also in the external flange 79*a* of the nozzle 70 shown in the version in FIGS. 12 and 13 of the capsule 1 of the invention.

It is further pointed out that all what has been stated regarding the closing element 39 shown in the FIGS. 16 and 17 and provided for insulating the cavity 5 against the external environment, disclosed above with particular reference to the nozzle 7 of the capsule 1 of the FIGS. 1-11 may be applied also to the nozzle 70 of the version of the capsule 1 illustrated in the FIGS. 12 and 13.

Again, it has been stated above that the covering element 19 is fixed by welding to the nozzle 7 to create a fluid seal between the covering element 19 and the first end 8 of the nozzle 7.

Again, what has been disclosed above with particular reference to the nozzle 7 of the capsule 1 of the FIGS. 1-11 may be applied also to the nozzle 70 of the version of the capsule 1 illustrated in the FIGS. 12 and 13, fixed by welding to the covering element 19.

The invention claimed is:

1. Capsule, comprising:

a casing provided with a base wall and with a side wall defining a cavity suitable for containing an initial product to be joined to a fluid for making a final product;

a nozzle associated with said casing and comprising a longitudinal side wall and a first end provided with a first opening suitable to engage a fluid injecting arrangement of a brewing machine, said longitudinal side wall being provided with at least one outflow opening connected to said first opening through a first duct for dispensing said fluid in said cavity in an injecting step;

a mixing element rotatably coupled with said nozzle at said outflow opening and shaped in such a manner as to divert at least one jet of fluid coming from said outflow opening and be rotated by said jet around said nozzle so as to create inside said cavity a vortex flow of fluid and product.

2. Capsule according to claim 1, wherein said mixing element is rotatable around a rotation axis coinciding with a longitudinal axis of said nozzle and comprises a central portion, which is rotatably couplable with said nozzle, and coaxially mounted on said nozzle in an assembled configuration, and at least one elongated shaped blade is fixed to said central portion and extending from said central portion substantially radially outwardly.

3. Capsule according to claim 2, wherein said central portion comprises a supplying opening made at each said blade and connected to said outflow opening so as to generate a respective jet of fluid and to convey said jet towards each said blade.

4. Capsule according to claim 3, wherein said nozzle comprises a supplying groove supplied by said outflow opening, said mixing element being coupled with said nozzle in said assembled configuration in such a manner that said supplying opening faces and is connected to said supplying groove for receiving said fluid.

5. Capsule according to claim 2, wherein said mixing element comprises a plurality of said blades that are fixed radially to said central portion and are angularly spaced apart from one another, said central portion comprising a supplying opening for each blade in order to generate a respective jet of fluid and to convey said jet towards each of said blades.

6. Capsule according to claim 2, wherein each blade comprises a shaped portion having a concave shape for intercepting said jet of fluid coming from said supplying opening.

7. Capsule according to claim 2, wherein each said blade comprises a tubular element provided with an exit opening arranged at an external end of said blade, and an internal duct for guiding said jet of fluid coming from said supplying opening to said exit opening.

8. Capsule according to claim 7, wherein said exit opening is in a side wall of said blade so as to eject said jet of fluid parallel to said base wall and transversally and substantially tangentially to said blade with respect to a rotation axis of said mixing element.

9. Capsule according to claim 8, and comprising a pair of said blades which are opposite one another, each said blade being provided with a respective exit opening on opposite side walls to direct said jets of fluid along parallel but opposite directions.

10. Capsule according to claim 2, wherein each said blade comprises a respective pair of elongated stems which have a different height and which are transversally fixed to said blade, and which are tilted with respect to a rotation axis of said mixing element.

11. Capsule according to claim 2, wherein each said blade comprises a respective flap with a triangular shape fixed transversally, to each said blade, a base of said flap being fixed to each said blade over the entire length of said blade.

12. Capsule according to claim 1, comprising a locking arrangement for elastically and removably restraining said mixing element to said nozzle in said assembled configuration and for allowing said mixing element free rotation around said nozzle.

13. Capsule according to claim 12, wherein said locking arrangement comprises at least one stop tooth associated with a central portion of said mixing element and arranged for elastically engaging a stop groove made in said nozzle.

14. Capsule according to claim 1, wherein said nozzle comprises a second end opposite to said first end and at least partially protruding from said cavity through an exit opening made in said base wall.

15. Capsule according to claim 14, wherein said second end of said nozzle has an external flange which, in an initial configuration of said capsule, abuts against an external surface of said base wall.

16. Capsule according to claim 14, wherein said second end of said nozzle has an external flange and wherein said capsule comprises a closing element removably fixed to said external flange and/or to an external surface of said base wall.

17. Capsule according to claim 16, wherein said closing element comprises a joining edge, said joining edge being fixed by a first part to said external surface of said base wall by a blocking seal and by a second part by a peelable seal, said blocking seal requiring greater force than said peelable seal to detach said joining seal from said base wall, so as to promote said detachment of said second part before said detachment of first part.

18. Capsule according to claim 14, wherein said second end is provided with a second opening flowingly connected by a second duct with a dispensing opening made in said longitudinal side wall of said nozzle, said dispensing opening, said second duct and said second opening enabling said final product to exit from said cavity and be dispensed directly into a fruition container in a dispensing step.

19. Capsule according to claim 18, wherein said first duct and said second duct are positioned side by side and extend substantially over the entire length of said nozzle, said outflow opening being made in the proximity of said second end, said dispensing opening being made in the proximity of said first end.

20. Capsule according to claim 18, and comprising a solid product contained in said second duct closed by said closing element and dispensable directly into said fruition container through said second opening before said dispensing step.

21. Capsule according to claim 20, wherein said solid product is constituted of a single element having at least one dimension that is greater than, or the same as, a width of said dispensing opening in such a manner that said dispensing opening prevents said solid product from exiting said second duct towards said cavity.

22. Capsule according to claim 20, wherein said solid product is constituted of a plurality of elements each having at least one dimension that is greater than, or the same as, a width of said dispensing opening in such a manner that said dispensing opening prevents said solid product from exiting said second duct towards said cavity.

23. Capsule according to claim 22, wherein said elements are homogeneous elements.

24. Capsule according to claim 18, and comprising an interaction arrangement for interacting with said final product which is contained in said second duct for changing characteristics of said final product before dispensing into said fruition container.

25. Capsule according to claim 24, wherein said interaction arrangement comprises an element for creating a vortex flow and/or a perforated element for making a filtering function or alternatively for reducing or eliminating possible froth present in the final product.

26. Capsule according to claim 25, wherein said element for creating a vortex flow comprises an elongated tubular shaped insert having a longitudinal side wall provided with a helicoidal projection extending longitudinally at least along a portion of said insert, preferably along the entire insert.

27. Capsule according to claim 26, wherein said capsule has an annular gap between a smooth wall of said second duct and said side wall of said insert provided with said projection, said annular gap having helicoidal channels for creating said vortex flow.

28. Capsule according to claim 1, wherein said casing is deformable and/or compressible along a direction that is transversal, in particular orthogonal, to said base wall in order to enable said final product to exit from said cavity and said nozzle to further exit from said cavity.

29. Capsule according to claim 28, wherein said nozzle comprises a second end opposite to said first end and coming out at least partially from said cavity through an exit opening made in said base wall and wherein said nozzle is inserted and sealingly slides with interference in said exit opening when said casing is compressed and/or crushed.

30. Capsule according to claim 29, wherein said nozzle includes a first portion arranged for engaging with interference and sliding inside said exit opening in a sealed manner so as to prevent said fluid and/or product exiting from said cavity and a second portion that is interposed between said first portion and said first end and provided with a cross section so as to enable said final product to exit from said cavity through said exit opening when said casing is compressed and/or crushed so as to lead said second portion at said exit opening.

31. Capsule according to claim 1, and comprising a covering element fixed to an edge of said casing for hermetically closing said cavity, said covering element being perforable by said injecting arrangement of the brewing machine for enabling said injecting arrangement to engage said first opening of said nozzle.

32. Capsule according to claim 31, wherein said covering element is fixed by welding to said first end of said nozzle.

33. Capsule according to claim 17, wherein said first part extends in a first angular interval comprised between 80° and 110°, and said second part extends in a second angular interval that is explementary to said first angular interval, said first part and said second part extending over the entire joining edge.

34. Capsule according to claim 17, wherein said second part comprises a detachment promoting arrangement comprising at least one detachment portion at which said second portion has a substantially "V" or wedge shape to facilitate a gradual and progressive separation of the joining edge from the base wall.

35. Capsule according to claim 34, wherein said first part is devoid of said detachment promoting arrangement.

36. Capsule according to claim 34, wherein said detachment promoting arrangement comprises a plurality of detachment portions that are angularly equidistant in said second part.

37. Capsule according to claim 17, wherein said closing element comprises an elongated tab extending outwards from a connecting portion of the joining edge that extends from said first part.

* * * * *